US006290200B1

(12) United States Patent
Ko

(10) Patent No.: US 6,290,200 B1
(45) Date of Patent: Sep. 18, 2001

(54) COLLAPSIBLE PAPER, BOOK HOLDER

(76) Inventor: Frank Ko, 3R 2th Fl, No. 6, Ta-An West St., Taichung (TW)

( * ) Notice: Subject to any disclaimer, the term of this patent is extended or adjusted under 35 U.S.C. 154(b) by 0 days.

(21) Appl. No.: 09/510,478

(22) Filed: Feb. 23, 2000

(51) Int. Cl.[7] ..... B41J 11/02
(52) U.S. Cl. ..... 248/442.2; 248/447.2; 248/918
(58) Field of Search ..... 248/442.2, 231.41, 248/918, 451, 460, 231.61, 447.2

(56) References Cited

U.S. PATENT DOCUMENTS 4,619,429 * 10/1986 Mazza ..... 248/447.2
4,869,565 * 9/1989 Bachman ..... 312/234
5,082,235 * 1/1992 Crowther et al. ..... 248/918
5,125,612 * 6/1992 McNeal ..... 248/442.2
5,292,099 * 3/1994 Isham et al. ..... 248/442.2
5,499,793 * 3/1996 Salansky ..... 248/442.2
5,988,582 * 11/1999 Olivo ..... 248/442.2
6,145,799 * 11/2000 Khon ..... 248/442.2

* cited by examiner

*Primary Examiner*—Anita King
*Assistant Examiner*—Gwendlyn Baxter
(74) *Attorney, Agent, or Firm*—Pro-Techtor International Services

(57) ABSTRACT

A collapsible papers, book holder, which includes two holder plates, and a mounting assembly for mounting on a housing of computer monitor is used to hold the holder plates at two sides, wherein the mounting assembly includes two angle frames bilaterally attached to the top and side walls of housing of the computer monitor, a screw rod connected to the angle frames on the top, and an adjusting knob firmly fixed in the screw rod to move the angle frames close or separate, the holder plates are respectively pivoted to the angle frames, each having a paper clip for holding thinner paper, and a pen holder means for holding writing tools.

4 Claims, 2 Drawing Sheets

COLLAPSIBLE PAPER, BOOK HOLDER

BACKGROUND OF THE INVENTION

The present invention relates to a paper, book holder, and more particularly to a collapsible paper, book holder for using on a computer monitor.

Many paper, book holders have been disclosed, those desk-top holders are usually mounted on a table, particularly when a personal computer with its peripherals such as keyboard, printer, monitor, mouse pad, scanner etc., are occupied much table space, so there is no much table space left for user to put papers, books, files or stationery, this will be very inconvenient to the user during the operation of P.C. A mis-touch of keyboard may cause serious errors or un-expectable trouble.

SUMMARY OF THE INVENTION

The principal object of the present invention is to provide a paper, book holder which is collapsible. Another object is that it can be quickly mounted on the housing of computer monitor without occupying any table-top space. It is still another object of the present invention is to provide a paper, book holder which is adjustable to fit any size of computer monitors. According to one aspect of the present invention, the holder comprises two holder plates each equipped with a paper clip for holding paper, and a mounting assembly for mounting on a monitor housing to hold the holder plates at two sides. According to another aspect of the present invention, the mounting assembly comprises two angle frames bilaterally attached to top and lateral side walls of the monitor housing, these two angle frames are connected by a screw rod at the top of monitor, and an adjusting knob is considerably designed on the screw rod to move the angle frames close or separate in accordance with the size of the computer monitor on which the paper, book holder is to be mounted. According to still another aspect of the present invention, the holder plates are respectively pivoted to the angle frames, each having a pen holder means on the bottom of plate.

DETAILED DESCRIPTION OF THE PREFERRED EMBODIMENT

Figure 1:
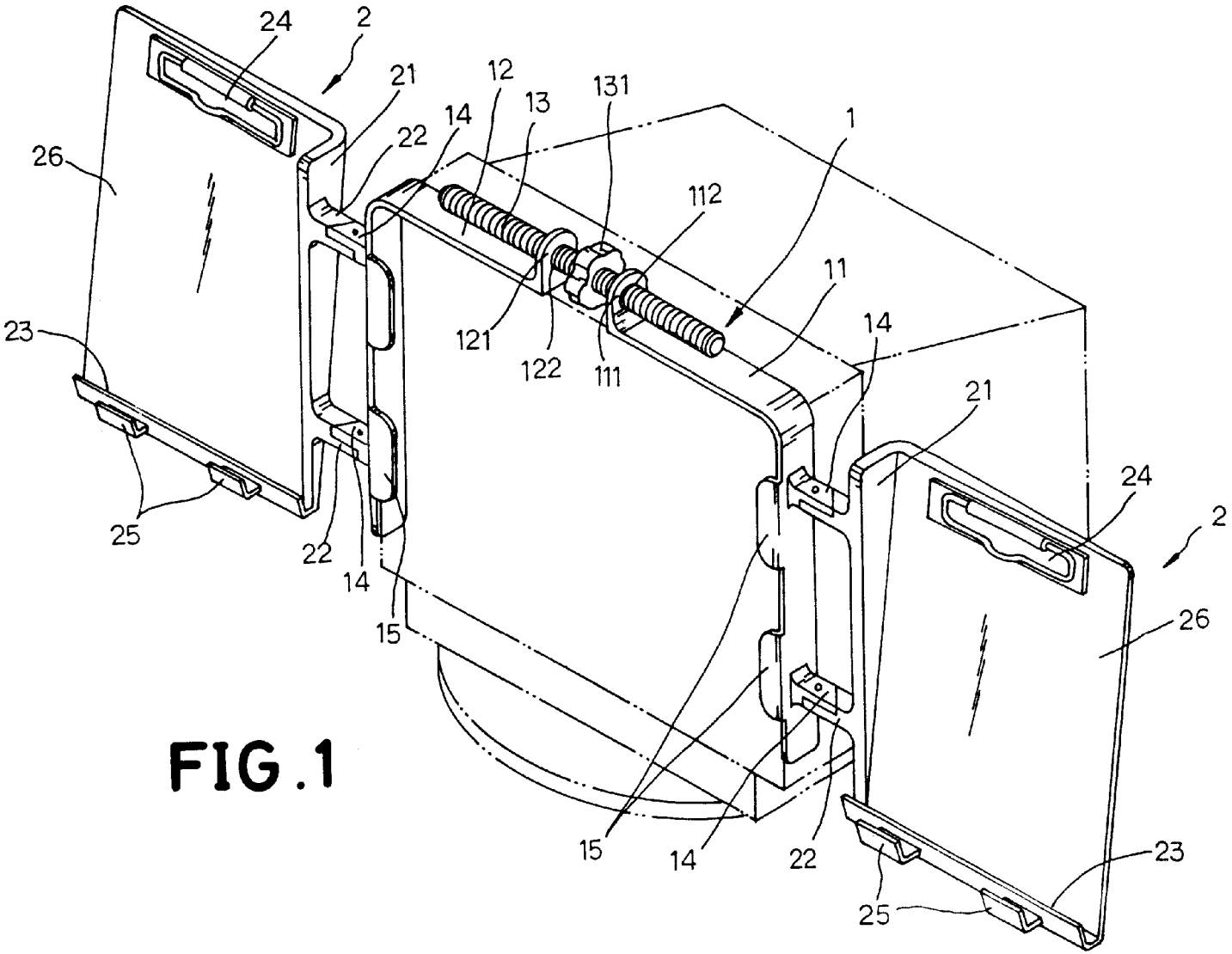
FIG. 1 is a perspective view of the present invention, showing the collapsible holder installed on a computer monitor.

Referring to FIG. 1, a collapsible paper, book holder in accordance with the present invention is shown and comprised of a mounting assembly 1, and two holder plates 2. The mounting assembly 1 comprises two angle frames, namely, the first angle frame 11 and the second angle frame 12, a screw rod 13, and an adjusting knob 131. The angle frames 11 and 12 both comprise a raised end block 111, 121, and the screw holes 112, 122 at the center of raised end block 111, 121 are threaded reversely. The angle frames 11 and 12 each further comprises two bevel-end lugs 14 perpendicularly raised, and two stop flanges 15 vertically spaced at one lateral side of the frames. The screw rod 13 is threaded and goes through the screw hole 112 of the first angle frame 11 and the screw hole 12 of the second angle frame 12. The adjusting knob 131 is properly assembled on the screw rod 13 and spaced between the raised end block 111 and 121, and rotated to move the angle frames 11 and 12 each other relatively close or separate. Each holder plates 2 is designed to give a slant, it comprises a substantially triangular side wall 21 raised from its one lateral side, two bevel-end lugs 22 perpendicularly raised and respectively pivoted to the bevel-end lugs at one angle frame 11 or 12, and a horizontal channel holder 23 formed integral on the bottom side of holder plate 2.

Referring to FIG. 1 again, the angle frames 11 and 12 are mounted on the housing of the computer monitor, yet the adjusting knob 131 is rotated to move the angle frames 11 and 12 toward each other and to fix the angle frames 11 and 12 tightly at two opposite sides of the computer monitor. Also, at this time, the two stop flanges 15 of the angle frames 11 and 12 does provide a function of preventing the holder from falling down to backward.

Figure 2:
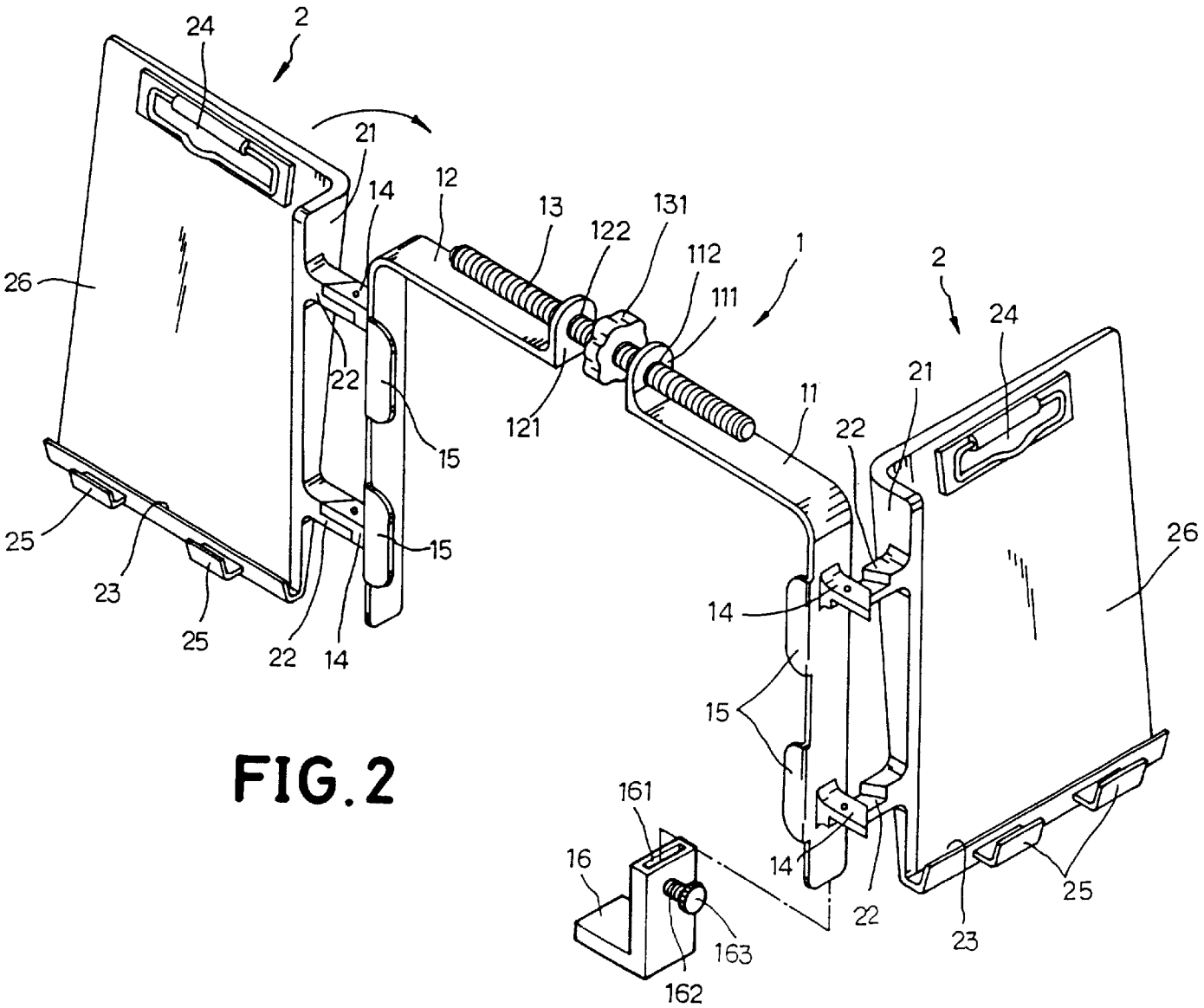
FIG. 2 illustrate holder plates turned relative to the respective angle frames according to the present invention.

Referring to FIG. 2, the holder plates 2 can be completely opened to the user, or to be folded close to the housing of monitor.

Referring to FIGS. 1 and 2 again, each holder plate 2 is equipped with a paper clip 24 for holding paper. A magnetic pad 26 is designed in front side of each holder plate 2, so that a thinner paper can be securely and flatly attached on the magnetic pad 26 by magnetic strips. A pen holder means 25 may be provided at the bottom of holder plate 2 to hold writing tools likely pen, ruler, eraser etc.

Referring to FIG. 2 again, an angle block 16 may be respectively fastened to the bottom end of angle frame 11 or 12 for positioning the whole holder on the computer monitor positively. The angle block comprises a coupling hole 161 at its one end, which receives the bottom end of each angle frames 11 or 12, a screw hole 162 at one side, and a tightening-up screw 163 threaded into the screw hole 162 to fix the angle block 16 to the angle frame 11 or 12.

What the invention claims is:

1. A collapsible document holder for a computer monitor comprising:

a mounting assembly comprising a first angle frame, a second angle frame, a screw rod that passes through said first angle frame and said second angle frame, and an adjusting knob mounted on said screw rod such that rotating said adjusting knob changes a spacing between said angle frames, and a holder plate pivotally attached to each of said first and said second angle frames, said holder plates each comprising a slanted wall with a horizontal channel at a bottom side thereof to receive documents; wherein said angle frames each comprise a pair of stop flanges extending inward from a front surface of an end piece of each of said angle frames, and said angle frames each further comprise an angle block adjustably fastened to lower ends of said end pieces of said angle frames, said angle blocks extending inward from said angle frames; such that transverse members of said angle frames inadapted to contact an upper surface of the computer monitor, said end pieces of said angle frames is adapted to contact side surfaces of the computer monitor, said spacing between said angle frames being adjustable so that any size computer monitor is accommodated, said stop flanges contact a front surface of the computer monitor, and said angle blocks is adapted to contact a bottom surface of the computer monitor, a vertical position of said angle blocks being adjustable so that any size computer monitor is accommodated, said collapsible document holder thereby is adapted to contact the computer monitor on five surfaces such that said collapsible document holder is securely fixable in position on the computer monitor.

2. The collapsible document holder of claim 1, wherein:

at least one of said holder plates comprises a paper clip.

3. The collapsible document holder of claim 1, wherein:

at least one of said holder plates comprises a pen holder means.

4. The collapsible document holder of claim 1, wherein:

at least one of said holder plates comprises a magnetic pad.

* * * * *